US012085325B2

(12) United States Patent
Shi

(10) Patent No.: US 12,085,325 B2
(45) Date of Patent: Sep. 10, 2024

(54) ICE MAKER FOR A REFRIGERATOR AND METHOD FOR PRODUCING CLEAR ICE

(71) Applicant: Electrolux Home Products, Inc., Charlotte, NC (US)

(72) Inventor: Zhuochen Shi, Clemson, SC (US)

(73) Assignee: Electrolux Home Products, Inc., Charlotte, NC (US)

( * ) Notice: Subject to any disclaimer, the term of this patent is extended or adjusted under 35 U.S.C. 154(b) by 0 days.

(21) Appl. No.: 17/468,815

(22) Filed: Sep. 8, 2021

(65) Prior Publication Data

US 2023/0075580 A1 Mar. 9, 2023

(51) Int. Cl.
*F25C 1/18* (2006.01)

(52) U.S. Cl.
CPC ..... *F25C 1/18* (2013.01); *F25C 2300/00* (2013.01); *F25C 2600/02* (2013.01); *F25C 2700/12* (2013.01)

(58) Field of Classification Search
CPC .... F25C 1/18; F25C 2300/00; F25C 2600/02; F25C 2700/12; F25C 5/22; F25C 2600/00
USPC ..... 62/66
See application file for complete search history.

(56) References Cited

U.S. PATENT DOCUMENTS 3,146,606 A 9/1964 Grimes et al.
4,662,184 A * 5/1987 Pohl ..... F25D 21/006 62/234
4,774,814 A * 10/1988 Yingst ..... F25C 1/12 62/352
6,351,955 B1 * 3/2002 Oltman ..... F25C 1/04 62/353
6,532,751 B1 * 3/2003 Schenk ..... F25C 1/04 62/66
7,062,936 B2 6/2006 Rand et al.
9,383,134 B2 7/2016 Devilbiss et al.
10,260,789 B2 4/2019 Alshourbagy et al.
10,551,100 B2 2/2020 Park et al.
10,605,493 B2 3/2020 Singh et al.
(Continued)

FOREIGN PATENT DOCUMENTS

CN 105758100 7/2016
JP H-09269172 A * 10/1997
(Continued)

OTHER PUBLICATIONS

KR-2020031957-A (Year: 2020).*
(Continued)

*Primary Examiner* — Eric S Ruppert
*Assistant Examiner* — Kirstin U Oswald
(74) *Attorney, Agent, or Firm* — Pearne & Gordon LLP

(57) ABSTRACT

An ice maker for a refrigeration appliance, the ice maker including an ice maker frame and an ice tray housed within the ice maker frame and configured to form ice pieces therein. An air handler is disposed adjacent the ice maker frame and an ice maker fan is disposed within the air handler and is configured to direct cooled airflow out of the air handler and into the ice maker frame. A controller is configured to operatively control the ice maker during an ice making cycle. The ice maker is operable in a first mode and a second mode. When the ice maker is operated in the second mode, the ice maker fan is cycled on and off during predetermined time intervals in order to produce clear ice pieces.

13 Claims, 9 Drawing Sheets

(56) References Cited

U.S. PATENT DOCUMENTS

| | | | | |
|---|---|---|---|---|
| 10,605,511 | B2 | 3/2020 | Bertolini et al. | |
| 2007/0227176 | A1* | 10/2007 | Anell | F25C 5/185 62/340 |
| 2008/0092567 | A1* | 4/2008 | Doberstein | F25C 5/187 62/137 |
| 2014/0182318 | A1* | 7/2014 | Eom | F25B 5/02 62/129 |
| 2017/0268797 | A1* | 9/2017 | Mowris | F24H 9/2064 |
| 2019/0360736 | A1 | 11/2019 | DuPlessis et al. | |
| 2020/0284492 | A1* | 9/2020 | Saito | F25D 17/062 |

FOREIGN PATENT DOCUMENTS

| | | | | |
|---|---|---|---|---|
| JP | H1183255 | A | * | 3/1999 |
| JP | 2001289544 | A | * | 10/2001 |
| JP | 2004060899 | | | 2/2004 |
| JP | 2004069201 | A | * | 3/2004 |
| JP | 2011202912 | | | 10/2011 |
| KR | 20100104264 | | | 9/2010 |
| KR | 20130020064 | | | 2/2013 |
| KR | 20130067221 | | | 6/2013 |
| KR | 20130086798 | | | 8/2013 |
| KR | 20170058255 | | | 5/2017 |
| KR | 20180010474 | | | 1/2018 |
| KR | 20190087238 | A | * | 7/2019 |
| KR | 2020031957 | A | * | 3/2020 ..... F25D 17/065 |
| WO | WO2011151177 | | | 12/2011 |

OTHER PUBLICATIONS

KR-2020031957-A, machine translation (Year: 2020).*
JP2001289544 A, machine translation (Year: 2023).*
JP H1183255 A, machine translation (Year: 2023).*
JP2004069201 A, machine translation (Year: 2023).*
JPH 09269172A, machine translation (Year: 2023).*
KR 20190087238A, machine translation (Year: 2023).*

* cited by examiner

ICE MAKER FOR A REFRIGERATOR AND METHOD FOR PRODUCING CLEAR ICE

FIELD OF THE INVENTION

This application relates generally to an ice maker for a refrigerator, and more particularly, an ice maker including an ice maker fan having an adjustable operational state in order to produce clear ice pieces.

BACKGROUND OF THE INVENTION

Conventional refrigeration applications, such as domestic refrigerators, typically have ice makers that produce ice pieces for user consumption. Such ice makers generally include a fan configured to direct a flow of cool air toward an ice tray positioned within the ice maker. Conventionally, the fan runs continuously at a constant operational speed during an entirety of an ice making cycle to rapidly cool the ice maker (e.g., the ice tray) in order to efficiently produce a maximum number of ice pieces in a short time period. Because of the rapid cooling (caused by the continuous operation of the fan at a constant operational speed during the entirety of the ice making cycle), there is not enough time for a sufficient amount of air bubbles to escape the water within the ice tray prior to a phase change of the water. Consequently, conventional ice makers are only capable of producing ice pieces that are generally cloudy or opaque (due to the trapped air bubbles in the frozen ice pieces). As such, while conventional ice makers efficiently produce ice pieces, those produced ice pieces have generally unaesthetic complexions.

BRIEF SUMMARY OF THE INVENTION

In accordance with one aspect, there is provided an ice maker for a refrigerator appliance. The ice maker comprises an ice maker frame and an ice tray housed within the ice maker frame and configured to form ice pieces therein. An air handler is disposed adjacent the ice maker frame and an ice maker fan is disposed within the air handler and is configured to direct cooled airflow out of the air handler and into the ice maker frame. A controller is configured to operatively control the ice maker during an ice making cycle. The ice maker is operable in a first mode and a second mode, wherein when the ice maker is operated in the second mode, the ice maker fan is cycled on and off during predetermined time intervals in order to produce clear ice pieces.

In accordance with another aspect, there is provided a method of controlling an ice maker to produce clear ice pieces. The ice maker includes an ice tray, an ice maker fan configured to direct cooled airflow about the ice tray, and a controller configured to operatively control the ice maker during an ice making cycle. The ice making cycle includes a filling phase, a freezing phase, and a harvesting phase. The method comprises the steps of initiating the filling phase such that water enters the ice tray. Thereafter, initiating the freezing phase such that the water in the ice tray undergoes a phase change and transitions into frozen ice pieces. The method further comprises the steps of cycling the ice maker fan between a first speed and a second speed during predetermined time intervals during the freezing phase, wherein the second speed is less than the first speed. Thereafter, initiating the harvesting phase such that said frozen ice pieces are disengaged from the ice tray.

In accordance with yet a further aspect, there is provided a method of controlling an ice maker to produce clear ice pieces. The ice maker includes an ice tray, an ice maker fan configured to direct cooled airflow about the ice tray, and a controller configured to operatively control the ice maker during an ice making cycle. The ice making cycle includes a filling phase, a freezing phase, and a harvesting phase, in that order. The method comprises the steps of initiating the filling phase such that water enters the ice tray and thereafter initiating the freezing phase such that the water in the ice tray undergoes a phase change and transitions into frozen ice pieces. The method further comprises the steps of operating the ice maker fan at a first speed, monitoring a rate of change of a temperature of the ice tray with respect to a first predetermined value, and adjusting operation of the ice maker fan from the first speed to a second speed, that is less than the first speed, when the rate of change of the temperature of the ice tray falls below said first predetermined value. Thereafter, initiating the harvesting phase such that said frozen ice pieces are disengaged from the ice tray.

DESCRIPTION OF EXAMPLE EMBODIMENTS

Figure 1:
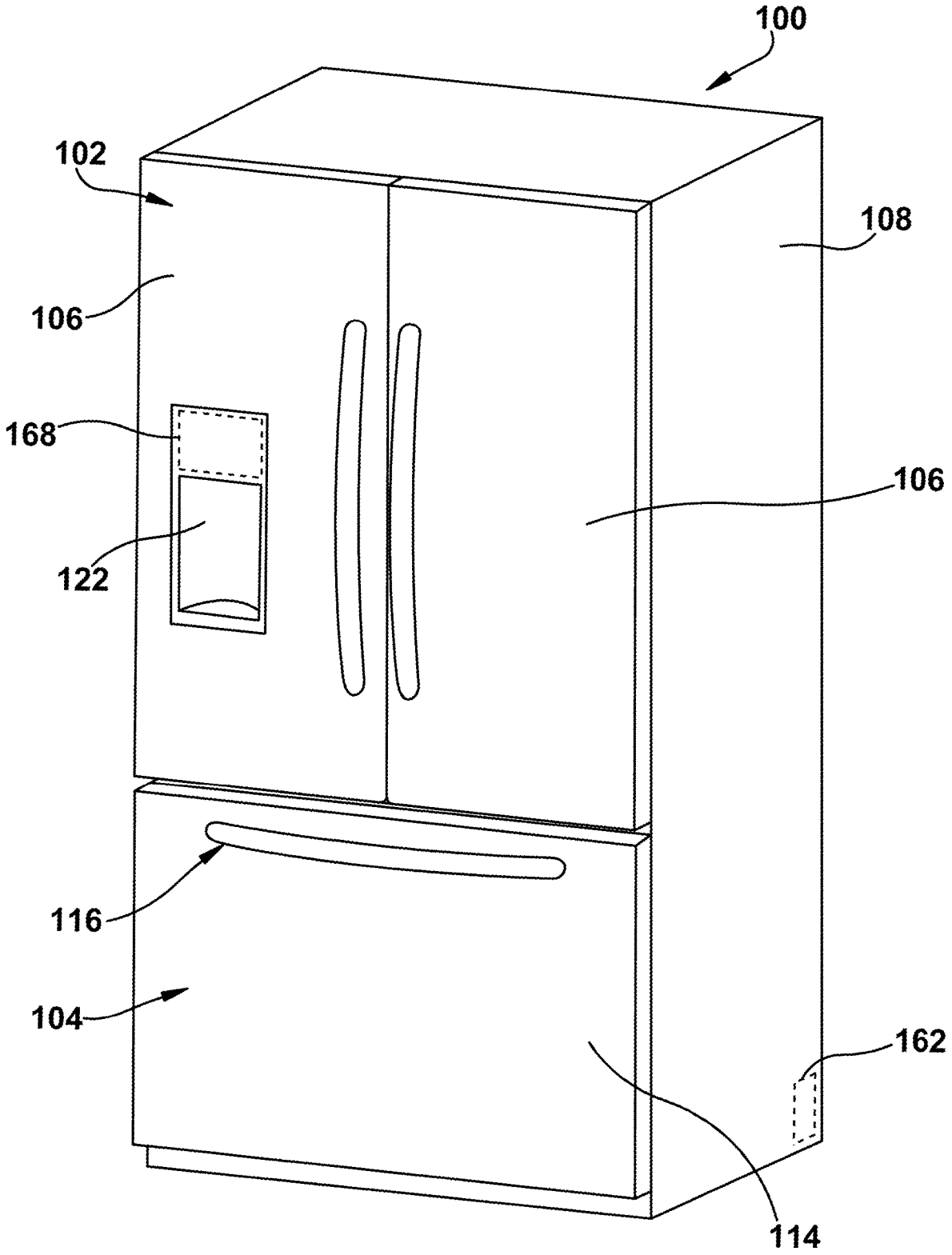
FIG. 1 is a front perspective view of a refrigerator.

Referring now to the drawings, FIG. 1 shows a refrigeration appliance in the form of a domestic refrigerator, indicated generally at 100. Although the detailed description that follows concerns a domestic refrigerator 100, the invention can be embodied by refrigeration appliances other than a domestic refrigerator 100. Further, an embodiment is described in detail below and shown in the figures as a bottom-mount configuration of a refrigerator 100, including a fresh food compartment 102 disposed vertically above a freezer compartment 104. It is to be understood that the refrigerator 100 can have any desired configuration including at least a fresh food compartment and/or a freezer compartment, such as a top mount refrigerator (freezer compartment disposed above the fresh food compartment), a side-by-side refrigerator (fresh food compartment is laterally next to the freezer compartment), a standalone refrigerator or freezer, a refrigerator having a compartment with a variable climate (i.e., can be operated as a fresh food compartment or a freezer compartment), etc.

One or more doors 106 are pivotally coupled to a cabinet 108 of the refrigerator 100 to restrict and grant access to the fresh food compartment 102. The door(s) 106 can include a single door that spans the entire lateral distance across the entrance to the fresh food compartment 102, or can include a pair of French-type doors 106, as shown in FIG. 1, that collectively span the entire lateral distance of the entrance to the fresh food compartment 102 to enclose the fresh food compartment 102.

Figure 2:
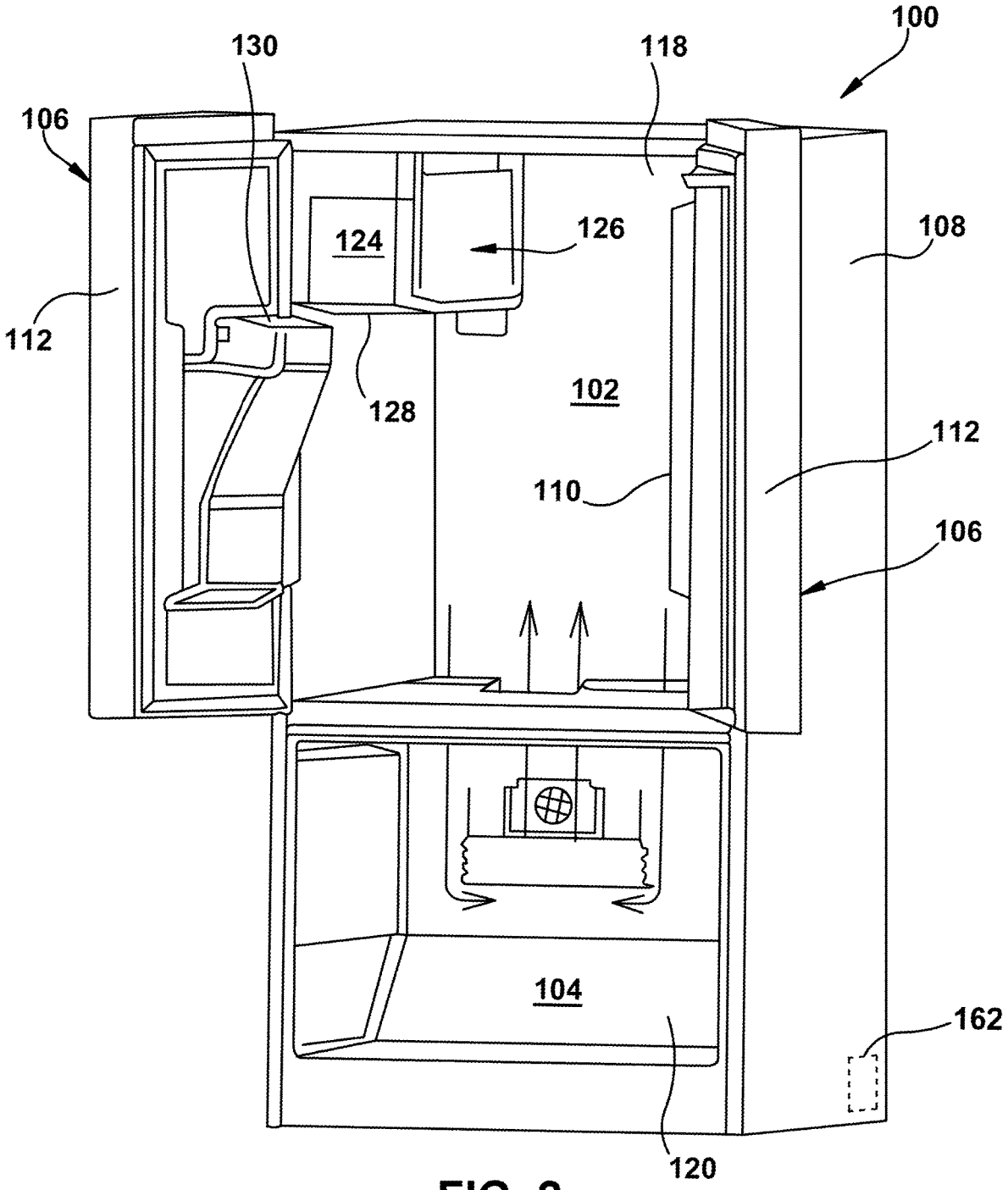
FIG. 2 is a front perspective view of the refrigerator in FIG. 1 showing doors of a fresh food compartment in an opened position and a door of a freezer compartment removed.

As shown in FIG. 2, a center flip mullion 110 is pivotally coupled to at least one of the doors 106 to establish a surface against which a seal provided to the other one of the doors 106 can seal the entrance to the fresh food compartment 102 at a location between opposing side surfaces 112 of the doors 106. The center flip mullion 110 can be pivotally coupled to the door 106 to pivot between a first orientation that is substantially parallel to a planar surface of the door 106 when the door 106 is closed, and a different orientation when the door 106 is opened. The externally-exposed surface of the center flip mullion 110 is substantially parallel to the door 106 when the center flip mullion 110 is in the first orientation, and forms an angle other than parallel relative to the door 106 when the center flip mullion 110 is in the second orientation. The seal and the externally-exposed surface of the center flip mullion 110 cooperate approximately midway between the lateral sides of the fresh food compartment 102.

Moving back to FIG. 1, the freezer compartment 104 is arranged vertically beneath the fresh food compartment 102. A drawer assembly (not shown) including one or more freezer baskets (not shown) can be withdrawn from the freezer compartment 104 to grant a user access to food items stored in the freezer compartment 104. The drawer assembly can be coupled to a freezer door 114 that includes a handle 116. When a user grasps the handle 116 and pulls the freezer door 114 open, at least one or more of the freezer baskets is caused to be at least partially withdrawn from the freezer compartment 104.

The freezer compartment 104 is used to freeze and/or maintain articles of food stored therein in a frozen condition. For this purpose, the freezer compartment 104 is in thermal communication with a freezer evaporator (e.g., freezer evaporator 202, discussed below) that removes thermal energy from the freezer compartment 104 to maintain the temperature therein at a temperature of 0° C. or less during operation of the refrigerator 100, preferably between 0° C. and −50° C., more preferably between 0° C. and −30° C. and even more preferably between 0° C. and −20° C.

Moving back to FIG. 2, the refrigerator 100 further includes an interior liner comprising a fresh food liner 118 and a freezer liner 120 which define the fresh food and freezer compartments 102, 104, respectively. The fresh food compartment 102 is located in the upper portion of the refrigerator 100 in this example and serves to minimize spoiling of articles of food stored therein. The fresh food compartment 102 accomplishes this by maintaining the temperature in the fresh food compartment 102 at a cool temperature that is typically above 0° C., so as not to freeze the articles of food in the fresh food compartment 102. It is contemplated that the cool temperature preferably is between 0° C. and 10° C., more preferably between 0° C. and 5° C. and even more preferably between 0.25° C. and 4.5° C.

Figure 3:
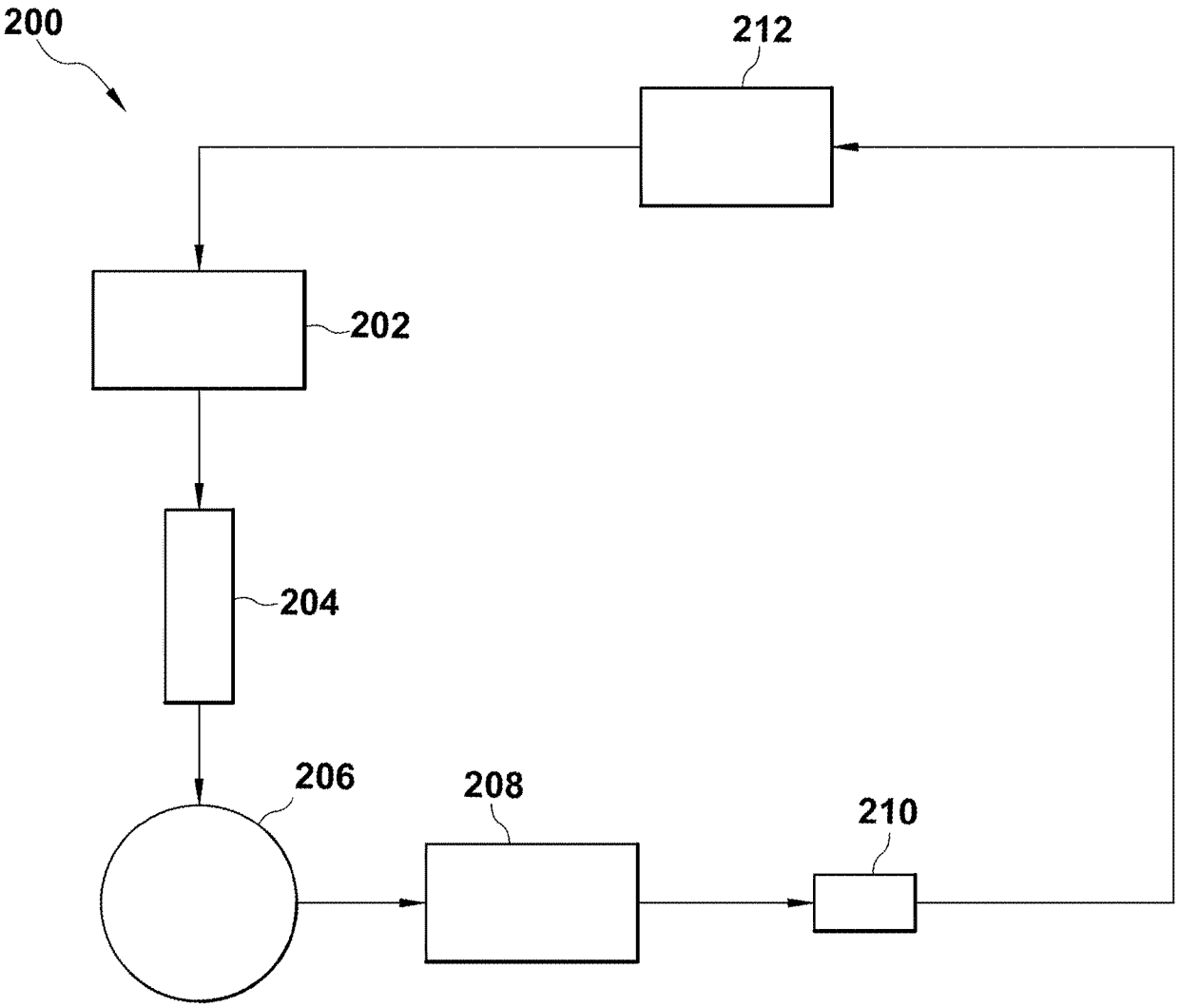
FIG. 3 is a schematic example of a cooling system of the refrigerator of FIG. 1.

Referring to FIG. 3, an example cooling system 200 of the refrigerator 100 is schematically shown. The cooling system 200 includes conventional components, such as a freezer evaporator 202, an accumulator 204 (optional), a compressor 206, a condenser 208, a dryer 210, and a dedicated ice maker evaporator 212, as discussed further below. These components are conventional components that are well known to those skilled in the art and will not be described in detail herein.

According to some embodiments, cool air from which thermal energy has been removed by the freezer evaporator 202 can also be blown into the fresh food compartment 102 to maintain the temperature therein greater than 0° C. preferably between 0° C. and 10° C., more preferably between 0° C. and 5° C. and even more preferably between 0.25° C. and 4.5° C. For alternate embodiments, a separate fresh food evaporator (not shown) can optionally be dedicated to separately maintaining the temperature within the fresh food compartment 102 independent of the freezer compartment 104. That is, the embodiments described herein may optionally also include a separate fresh food evaporator, which may be arranged in series with the freezer and ice maker evaporators 202, 212, or alternatively could be arranged on a parallel refrigerant path. According to an embodiment, the temperature in the fresh food compartment 102 can be maintained at a cool temperature within a close tolerance of a range between 0° C. and 4.5° C., including any subranges and any individual temperatures falling with that range. For example, other embodiments can optionally maintain the cool temperature within the fresh food compartment 102 within a reasonably close tolerance of a temperature between 0.25° C. and 4° C.

With respect to FIG. 1, a dispenser 122 is disposed at one of the doors 106 and is provided to dispense liquid (e.g., water) and/or ice pieces therefrom. As shown, the dispenser 122 is provided on an exterior of one of the doors 106 such that a user can acquire water and/or ice pieces without opening said door 106. Alternatively, it is contemplated that the dispenser 122 can be positioned on an interior of one of the doors 106 or on an interior wall of the refrigerator 100 such that a user must first open said door 106 before interacting with the dispenser 122.

In operation, when a user desires ice (e.g., ice pieces), the user interacts with an actuator (e.g., lever, switch, proximity sensor, etc.) to cause frozen ice pieces to be dispensed from an ice bin 124 (FIG. 2) of an ice maker 126. Ice pieces stored within the ice bin 124 can exit the ice bin 124 through an aperture 128 and be delivered to the dispenser 122 via an ice chute 130. In the embodiment shown, the ice chute 130 extends at least partially through the door 106 between the dispenser 122 and the ice bin 124. As further shown, the ice maker 126 is located within the fresh food compartment 102 and, more particularly, at an upper corner defined by the fresh food liner 118. Alternatively, the ice maker 126 (and possibly the ice bin 124) can be mounted to an interior surface of the door 106. It is further contemplated that the ice maker 126 and the ice bin 124 can be separate elements, in which one remains within the fresh food compartment 102 and the other resides on the door 106. In alternative embodiments (not shown), the ice maker 126 is located within the freezer compartment 104. In this configuration, both of the ice maker 126 and the ice bin 124 can be located wholly within the freezer compartment 104. In an alternate configuration, although still disposed within the freezer compartment 104, at least the ice maker 126 (and possibly the ice bin 124) is mounted to an interior surface of the freezer door 114. It is contemplated that the ice maker 126 and ice bin 124 can be separate elements, in which one remains within the freezer compartment 104 and the other is on the freezer door 114. For example, the ice maker 126 can be positioned within the freezer compartment 104 and the ice bin 124 can be located on the freezer door 114.

In further alternative embodiments, it is contemplated that the ice maker 126 and the ice bin 124 can reside in separate compartments of the refrigerator 100. For example, the ice maker 126 can be positioned within the freezer compartment 104 and the ice bin 124 can be disposed within the fresh food compartment 102. Alternatively, the ice maker 126 can be positioned within the fresh food compartment 102 and the ice bin 124 can be disposed within the freezer compartment 104. Further still, where the refrigerator 100 is a multi-compartment refrigerator including a variable climate compartment, both the ice maker 126 and the ice bin 124 can be disposed within said variable climate compartment, or one of the ice maker 126 and the ice bin 124 can be positioned within the variable climate compartment while the other is disposed within a separate compartment (e.g., the fresh food compartment 102 or the freezer compartment 104).

Additionally, when a user desires water, the user interacts with the actuator to acquire water from the dispenser 122. Generally, water is directed through a water circuit of the refrigerator 100 wherein it is pumped to the dispenser 122 from an external source (not shown). Typically, such water circuits include a series of water lines (e.g., conduits, tubes, etc.) to transport the water from the external source to the dispenser 122. Filters and water storage tanks are often also employed to filter the water passing therethrough and to store the water (either filtered or unfiltered) for subsequent downstream use.

Figure 4:
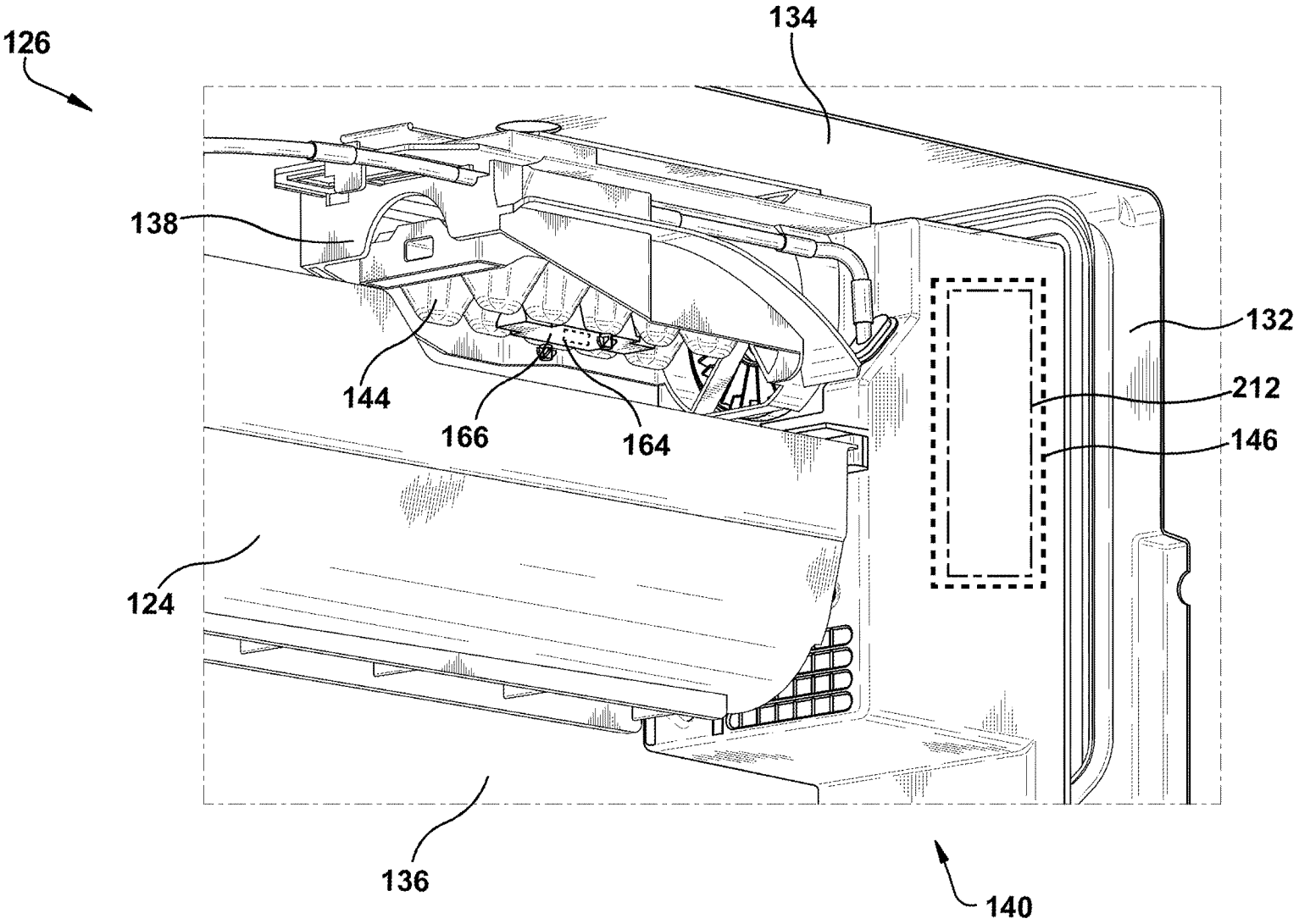
FIG. 4 is a partial, front sectional view of an interior of an upper portion of a refrigerator showing an ice maker.

Moving on to FIG. 4, the ice maker 126 is shown as being disposed at an upper corner of the fresh food compartment 102. Specifically, the ice maker 126 is located adjacent a rear wall 132, top wall 134, and side wall 136 of the fresh food liner 118. Alternatively, the ice maker 126 can be positioned at other locations within the fresh food compartment 102. For example, the ice maker 126 could be positioned at a lower corner of the fresh food compartment 102 (i.e., adjacent a horizontal mullion that separates the fresh food and freezer compartments 102, 104), on a storage shelf located within the fresh food compartment 102, or even on/within one of the doors 106 that provides selective access to the fresh food compartment 102.

The ice maker 126 is shown as comprising an ice maker frame 138, the ice bin 124, and an air handler 140. The air handler 140 is secured adjacent the rear wall 132 of the fresh food liner 118, and both the ice maker frame 138 and the ice bin 124 extend outwards therefrom towards a front of the refrigerator 100. Additionally, the ice maker frame 138 is disposed vertically above the ice bin 124 and houses an ice tray 144 therein. Due to this configuration, after the ice pieces have been formed, the ice pieces can then be harvested and transported downwardly into the ice bin 124 in an efficient manner. For example, the ice tray 144 may rotate about a horizontal axis until the ice pieces face the ice bin 124 and are subsequently ejected from the ice tray 144.

As further shown, the air handler 140 covers (i.e., houses) various components related to the functionality of ice making/dispensing. Specifically, as schematically shown in FIG. 4, the dedicated ice maker evaporator 212 and an ice maker fan 146 are disposed within the air handler 140 (i.e., positioned behind the air handler 140 and adjacent the rear wall 132 of the fresh food liner 118). Notably, the air handler 140 can house other features associated with ice making/dispensing, including at least an auger motor, a crush cube solenoid, EPS foam, electrical harnesses, etc. (not shown). Although shown schematically, the ice maker fan 146 can be located either above or below the ice maker evaporator 212, and in the illustrated embodiments of FIGS. 5-6, the ice maker fan 146 is located above the ice maker evaporator 212.

Figure 5:
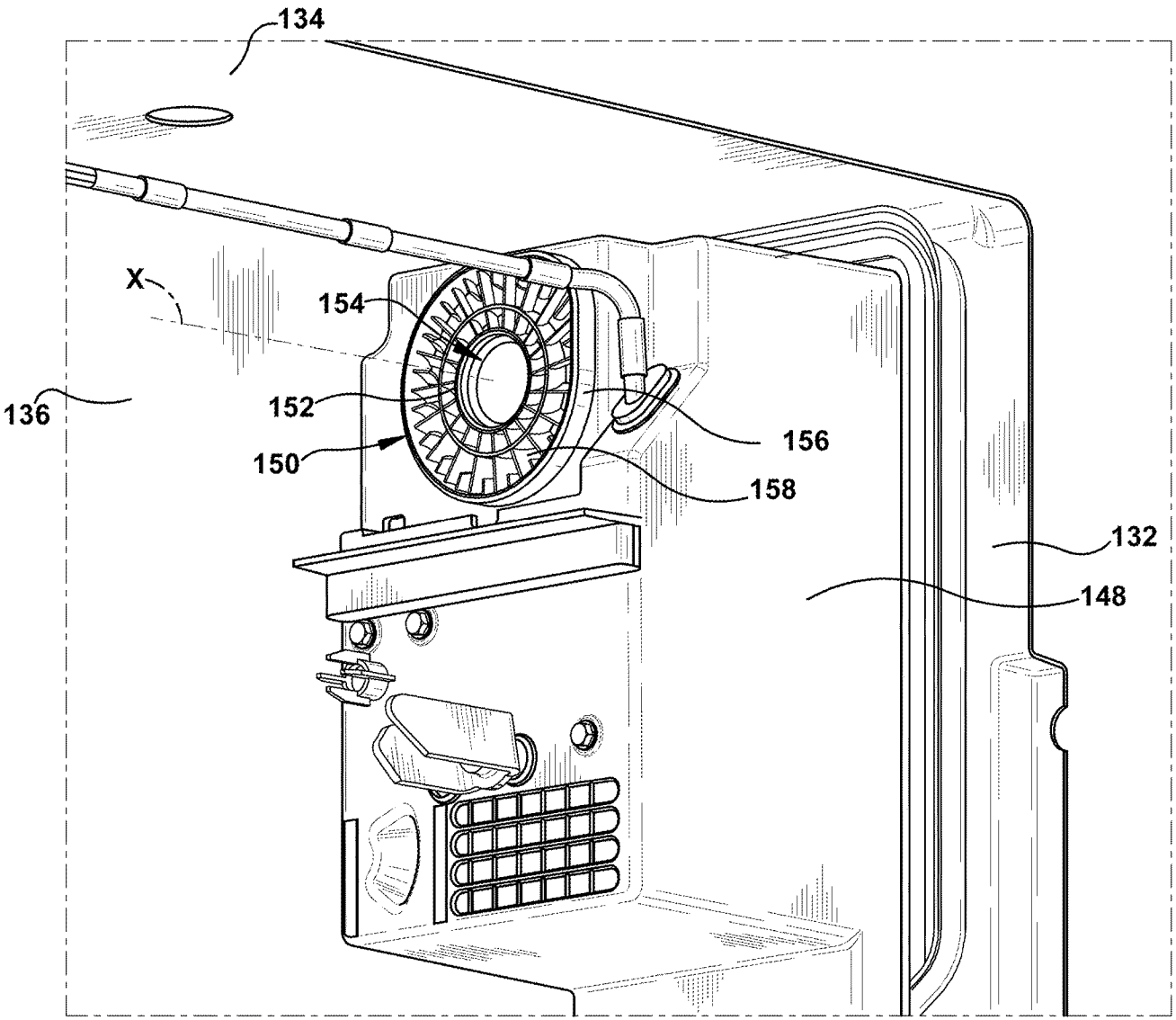
FIG. 5 is a front perspective view of one example air handler of the ice maker shown in FIG. 4.

Moving on to FIG. 5, the air handler 140 comprises a housing 148 with a fan outlet diffuser 150 formed in a front face thereof. The fan outlet diffuser 150 may be formed integral with the housing 148 during a simulations manufacturing process. Alternatively, the fan outlet diffuser 150 may be separate and distinct from the housing 148 such that the fan outlet diffuser 150 is manufactured individually with respect to the housing 148 and subsequently fixed thereto via known methods.

In one example embodiment, the fan outlet diffuser 150 is substantially circular in shape and includes a first wall 152 that defines a central body 154 of the fan outlet diffuser 150. Specifically, the first wall 152 is cylindrical in shape and extends axially along an axis "X." Notably, the central body 154 is provided at a radial center of the fan outlet diffuser 150. The first wall 152 is peripherally surrounded by a second wall 156. That is, the second wall 156 is radially spaced apart from the first wall 152. Moreover, the second wall 156 is shown as being substantially cylindrical in shape, wherein the first wall 152 and the second wall 156 of the fan outlet diffuser 150 are coaxial. A plurality of radially extending fins 158 are disposed circumferentially about the first wall 152 of the fan outlet diffuser 150. Specifically, the plurality of radially extending fins 158 are disposed between the first wall 152 and the second wall 156, wherein each of the plurality of radially extending fins 158 is spaced apart, one from the other, along an outer peripheral surface of the first wall 152. Alternatively, the fan outlet diffuser 150 can have a different shape (e.g., oval, rectangle, square, triangle, etc.).

Figure 6:
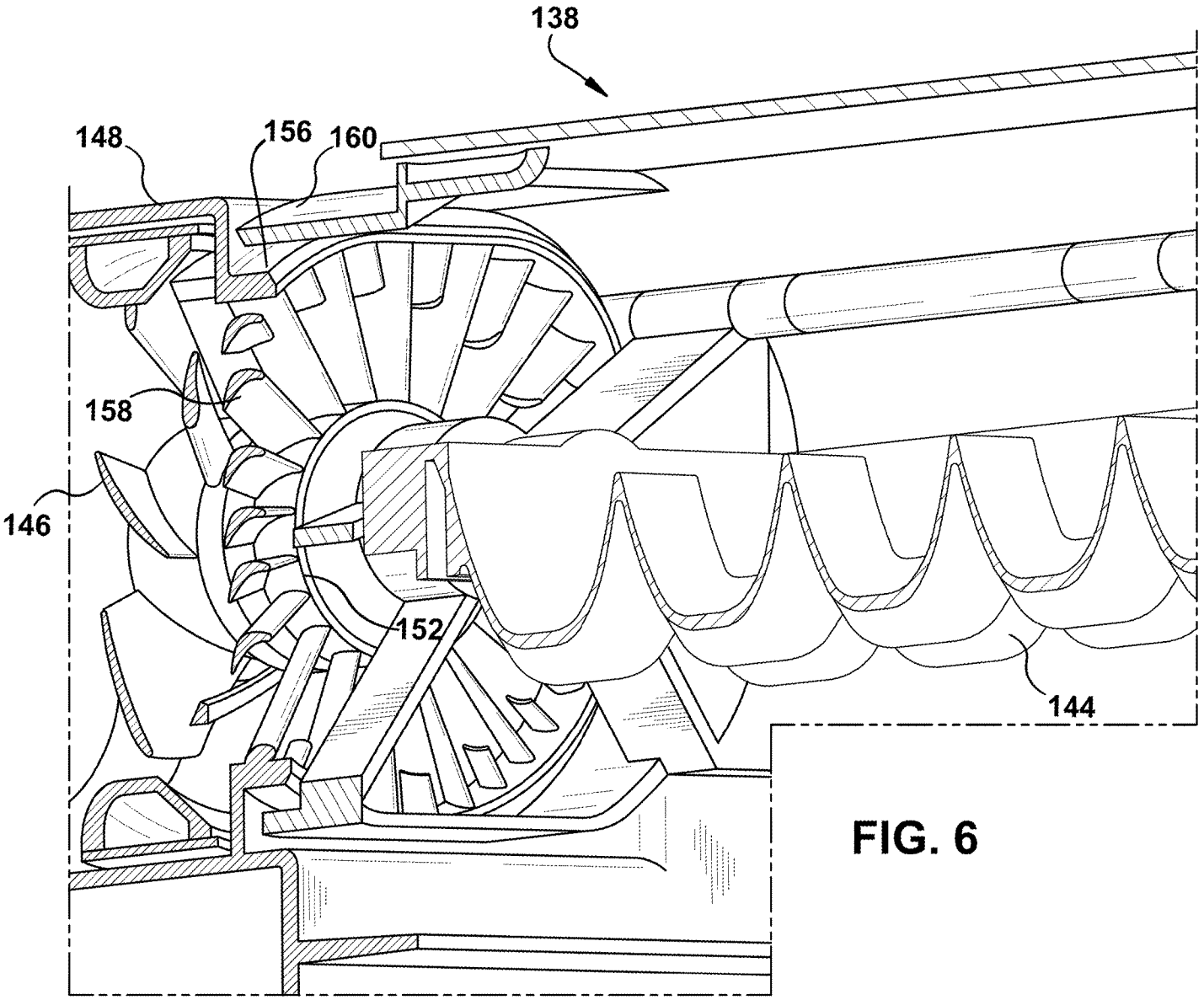
FIG. 6 is a perspective cross-sectional view of an example ice maker frame installed adjacent to the air handler.

With respect to FIG. 6 (depicting a partial, perspective cross-sectional view), the ice maker 126 is shown in an installed position. As shown, the ice maker frame 138 is disposed adjacent the front face of the housing 148 and extends outwards therefrom (e.g., along the axis 'X,' shown in FIG. 5). More specifically, the ice maker frame 138 has a distal end 160 that circumscribes the second wall 156 of the fan outlet diffuser 150. That is, the distal end 160 of the ice maker frame 138 is substantially circular in shape and is radially aligned with and disposed over the second wall 156 of the fan outlet diffuser 150.

As further shown, the ice maker fan 146 is located within the housing 148 of the air handler 140 and is positioned relatively close (i.e., directly adjacent) to the fan outlet diffuser 150, without any significant obstacles disposed therebetween. This configuration may reduce the number of obstacles between the air handler 140 and the ice tray 144 (as compared to conventional assemblies) so that the ice maker fan 146 can direct an airflow out of the fan outlet diffuser 150 and across the ice tray 144 in an efficient manner. Notably, the radially extending fins 158 are pitched opposite to blades of the ice maker fan 146. Due to this configuration, the radially extending fins 158 counteract any swirling effect caused by the pitch of the blades such that the airflow is directed into the ice maker frame 138 in a generally linear manner. Accordingly, due to the geometric configuration of the radially extending fins 158, the airflow is efficiently directed into the ice maker frame 138 in such a way that the airflow interacts and cools the entire ice tray 144. That is, the radially extending fins 158 prevent the airflow from rebounding back into the air handler 140 and/or not interacting/cooling the entire ice tray 144.

Figure 7:
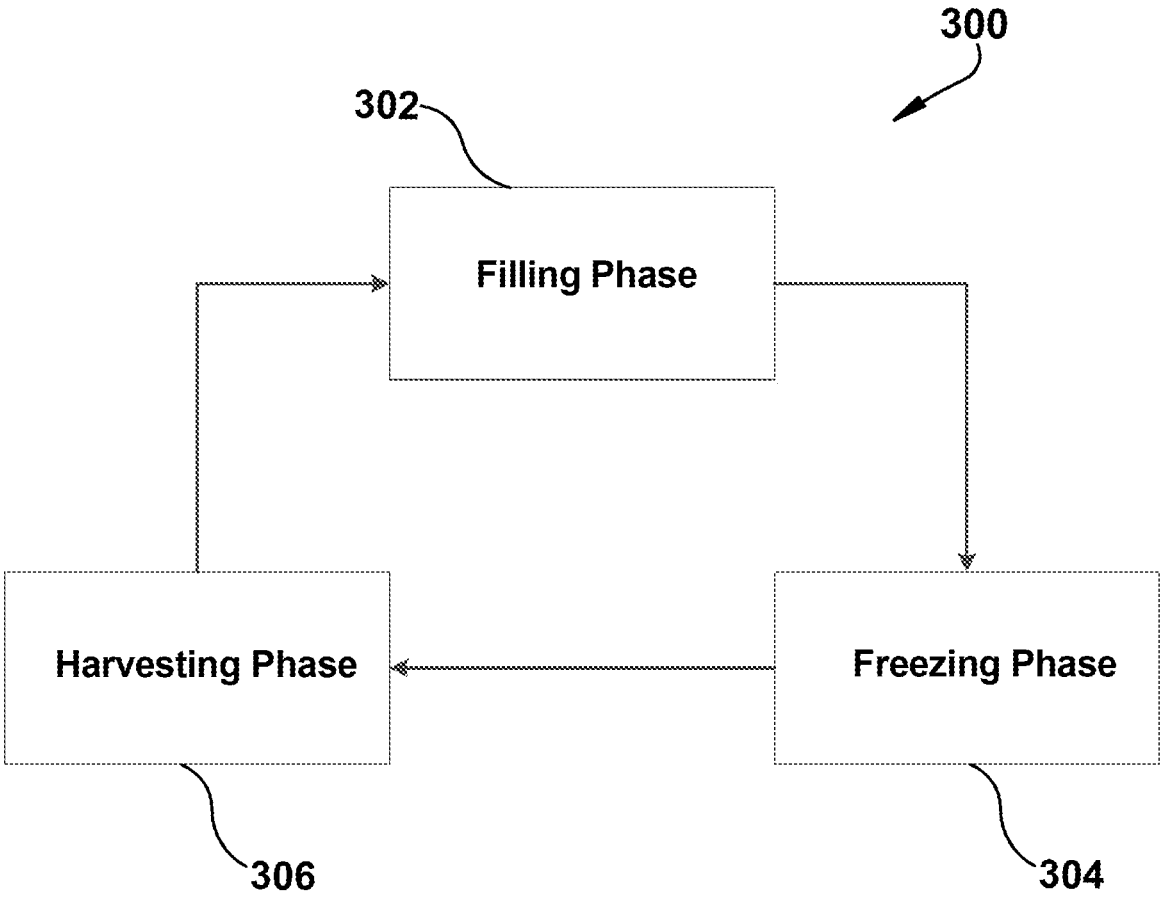
FIG. 7 is a flow chart of an ice making cycle for the ice maker shown in FIG. 4.
Figure 8:
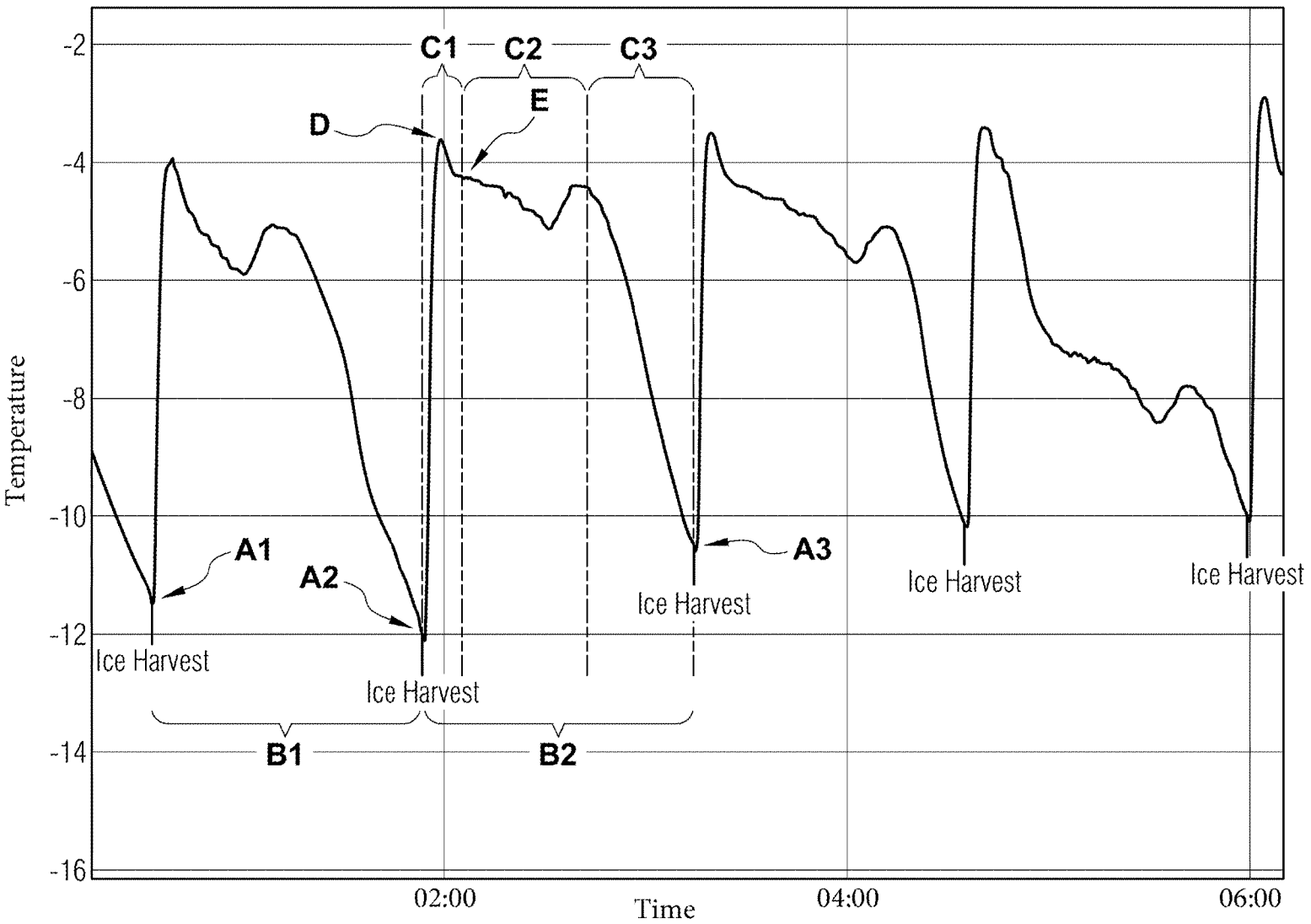
FIG. 8 is a temperature-time graph representing successive ice making cycles.
Figure 9:
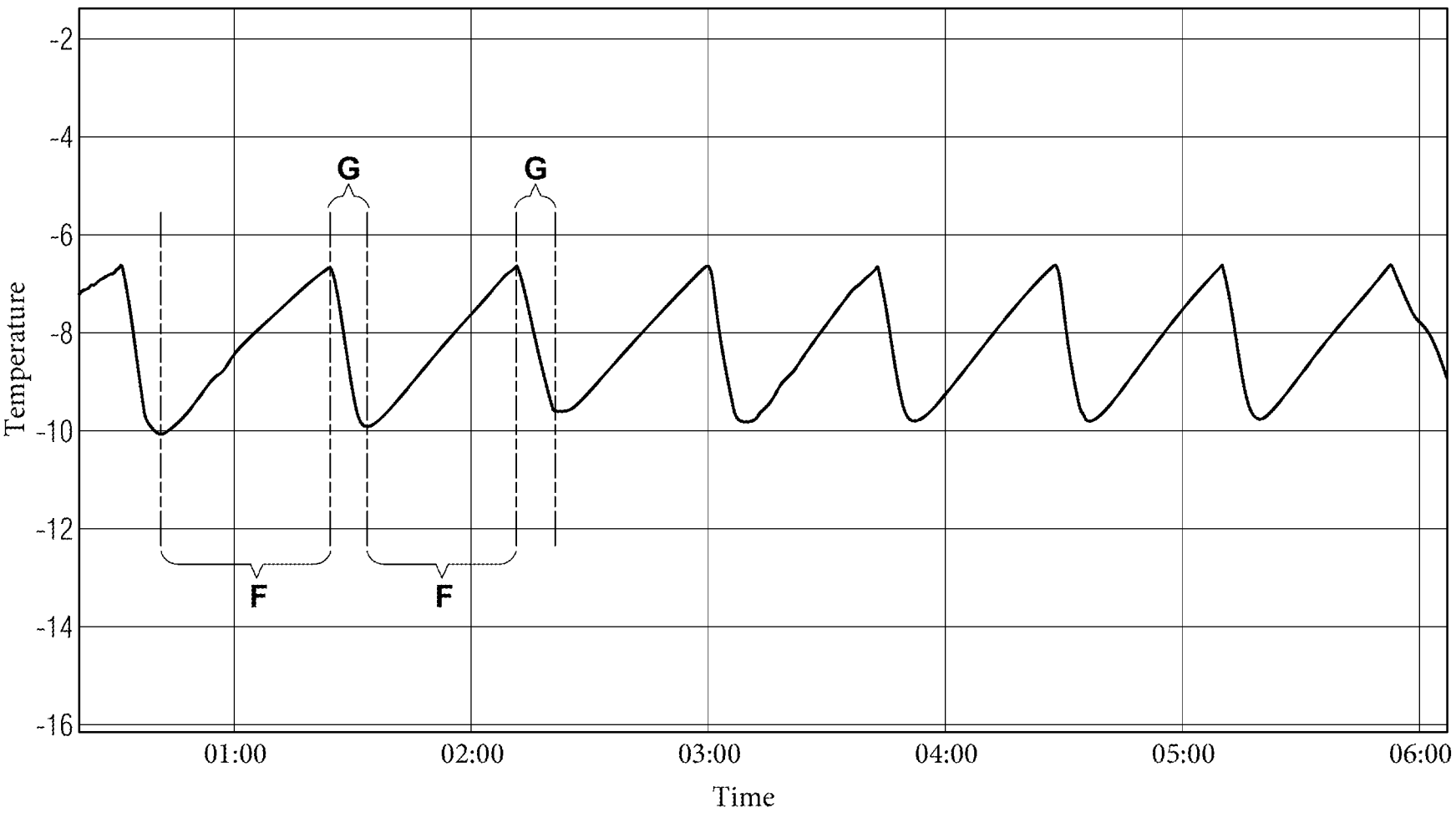
FIG. 9 is a temperature-time graph representing a temperature-time curve associated with cycling an ice maker fan on and off.

With reference to FIGS. 7-9, methods of forming ice pieces and operating the ice maker 126 will now be discussed. Specifically, FIG. 7 depicts a flow chart of an ice making cycle 300 of the aforementioned ice maker 126. In an initial step, a filling phase 302 is initiated wherein water, directed from an upstream source, enters the ice tray 144. The water may be transported from an external water source (e.g., a household water supply) or a source located within the refrigerator 100 (e.g., a water storage tank). Further, the commencement of the filling phase 302 may occur in various ways. Generally, the ice maker 126 will first perform a check of the amount of ice pieces already stored in the ice bin 124 to determine whether more ice should be made. For example, a mechanical bail arm (not shown) may reach into the ice bin 124 to physically sense the amount of ice pieces located therein. In another example, the ice maker 126 may include a sensor (e.g., a capacitance sensor) to sense an overall weight of the ice pieces within the ice bin 124 and compare the sensed weight to a predetermined weight indicative of various fill levels of ice pieces (e.g., full, half full, etc.) within the ice bin 124. Alternatively, other sensors may be used to determine a height of the ice pieces within the ice bin 124 to determine whether the ice bin 124 is full. Further still, the filling phase 302 may begin by user request.

Moreover, although not shown, the ice maker 126 may include sensors configured to determine when cavities in the ice tray 144 are filled with water. For example, the sensors may sense when the ice tray 144 is filled and send a signal to a controller 162 (shown schematically in FIGS. 1 and 2) to stop supplying water to the ice maker 126. In addition or alternatively, the ice maker 126 may use a timer that causes the water fill operation to happen for a predetermined amount of time. Alternatively, the ice maker 126 could use a water flow volume sensor to dispense a predetermined volume of water into the ice tray 144. Subsequently, after the filling phase 302 of the ice making cycle 300 is completed, a freezing phase 304 begins. Specifically, during the freezing phase 304, a temperature of the water within the ice tray 144 is reduced. This is accomplished by the ice maker evaporator 212 (disposed within the air handler 140) lowering the temperature of the air within the housing 148 of the air handler 140, and by the ice maker fan 146 forcefully directing said cooled air into the ice maker 126 (e.g., around the ice tray 144) to permit a phase change of the water within the ice tray 144. That is, the air within the ice maker 126 is cooled to a temperature that promotes the liquid water to freeze into solid ice pieces, preferably to a temperature well below zero degrees Centigrade.

After the freezing phase 304 has concluded (i.e., the water within the ice tray 144 has frozen into ice pieces), a harvesting phase 306 may begin. The function of the harvesting phase 306 is directed towards disengaging the ice pieces from the ice tray 144 and transferring the ice pieces to the ice bin 124. Various methods can be used to determine when the freezing phase 304 has concluded. In one example, a temperature sensor (e.g., temperature sensor 164, discussed below) can be located on the ice tray 144, such as on a bottom surface of the ice tray 144, to terminate the freezing phase 304 once the temperature of the water or frozen ice pieces in the ice tray 144 reaches a predetermined temperature. In addition or alternatively, a timer can be used to limit the freezing phase 304 to a predetermined amount of time. Before the harvesting phase 306 begins, one or more of these criteria must first be met. In one example using a combination of the above, a sensed temperature must be below a maximum harvest temperature and a minimum freeze time must be met.

The maximum harvest temperature is the maximum temperature of the ice pieces in the ice tray 144, as detected by a temperature sensor 164 (e.g., a thermistor), at which harvesting can occur. In one embodiment, the temperature sensor 164 (schematically shown in FIG. 4) may be positioned on a bottom of the ice tray 144. Specifically, the temperature sensor 164 may be inserted into a reception area formed into the ice tray 144 or, alternatively, be disposed adjacent a bottom thereof. Further, insulation (e.g., foam block insulation 166, as depicted in FIG. 4) is generally provided about the temperature sensor 164 (e.g., surrounding the sensor) so as to thermally isolate the temperature sensor 164 from air within the ice maker 126. In this manner, the temperature sensor 164 is capable of providing an accurate reading of the temperature of the water/ice within the ice tray 144, which is generally uninfluenced by the temperature of the air within the ice maker 126.

During operation, the temperature sensed by the temperature sensor 164 must be below (i.e., colder than) the maximum harvest temperature. The minimum freeze time is directed toward a minimum amount of time between the completion of the filling phase 302 and the initiation of the harvesting phase 306. That is, the minimum freeze time is a pre-set time period which must occur before the harvesting phase 306 initiates. Of note, the sensed temperature being below the maximum harvest temperature can be achieved before the minimum freeze time is reached, and vise-versa; however, the harvest phase 306 will not begin until both of the foregoing conditions are met.

As mentioned above, after the harvesting phase 306 begins, the ice pieces are ejected from the ice tray 144 and stored in the ice bin 124. The ice pieces can be harvested in various manners. In the shown example, the ice tray 144 can be of the twist-tray type, whereby the ice tray 144 is twisted along the axis X (schematically depicted in FIG. 5) such that one end of the ice tray 144 rotates farther than the opposite end. This action causes the recesses of the ice tray 144 to deform and eject the ice pieces therefrom. In other examples, the ice tray 144 could utilize a heater to warm the ice pieces enough to separate them from the ice tray 144, and/or a sweeper arm mechanism can be used to dislodge the ice pieces therefrom and transport them (e.g., via gravity) into the ice bin 124. Thereafter, the ice making cycle 300 may continue its operation by initiating the filling phase 302 once more. The ice making cycle 300 may be in constant operation until it is determined that the ice bin 124 has been filled with ice pieces. Alternatively, a predetermined time period may occur between each ice making cycle 300.

The example embodiment of the ice maker 126 discussed above is operable in separate modes in order to yield different types of ice pieces. More particularly, the ice maker 126 may be operated in at least a 'normal ice' mode (i.e., a first mode) and a 'clear ice' mode (i.e., a second mode). It is to be understood that the below-detailed 'modes' and their associated control architectures (described below) are embodied in the controller 162 (shown schematically in FIGS. 1 and 2), which includes various hardware and software (e.g., processors, memory, etc.) as commonly known. Notably, the controller 162 may control operation of the entire refrigerator 100 (including the ice maker 126). Alternatively, the below-detailed 'modes' may be embodied in a standalone controller (i.e., separate from the controller 162) that is dedicated solely to the ice maker 126.

When the 'normal ice' mode is selected, the ice maker 126 is configured to produce a maximum amount of ice pieces in the most efficient manner possible (i.e., governed by the criteria discussed above). While the 'normal ice' mode is configured to fill the ice bin 124 in a timely manner, the resulting ice pieces harvested during the 'normal ice' mode often have imperfections with respect to clarity. More specifically, the produced ice pieces are generally cloudy or opaque due to air bubbles entrapped within the ice pieces. In contrast, when the 'clear ice' mode is selected, the ice maker 126 is configured to produce ice pieces having generally clear clarity (i.e., transparent). However, the time it takes to complete the ice making cycle for each batch of 'clear ice' pieces is greater than that associated with the 'normal ice' mode. In one example, a complete ice making cycle for the 'clear ice' mode can take at least double the amount of time than that of the 'normal ice' mode. Specifically, in one further example, a complete ice making cycle for the 'normal ice' mode can take 70 minutes whereas a complete ice making cycle for the 'clear ice' mode can take 145 minutes, although it is to be appreciated that the actual amount of time in minutes may vary based upon several factors including the temperature of the ice-making compartment, the shape of the ice cubes in the ice tray 144, the amount of water filled within the ice tray 144, etc. Accordingly, it takes a greater amount of time to fill the ice bin 124 when the 'clear ice' mode is selected than when the 'normal ice' mode is selected, so that the air bubbles have sufficient time to be released from the water prior to being frozen into the solid ice pieces.

The selection of these various 'modes' can be preprogrammed into the controller 162, can be entirely user dependent (i.e., user selectable), or can be a combination of both. For example, the controller 162 can operate the ice maker 126 in the 'normal ice' mode by default. As such, in order for clear ice pieces to be produced, the user must interact with a user interface 168 (shown schematically in FIG. 1) in order to switch from the 'normal ice' mode to the 'clear ice' mode. Alternatively, operation of the ice maker 126 can depend entirely on user request. As such, ice pieces will not be produced until the user selects either the 'normal ice' mode or the 'clear ice' mode. Notably, while the user interface 168 is shown as being disposed above the dispenser 122 in FIG. 1, it is to be understood that the user interface 168 may be positioned at other locations (e.g., on one of the opposing side surfaces 112 of the doors 106, on a surface of the ice bin 124, etc.). Further, it is to be understood that the user interface 168 can include one or more actuators (e.g., switches, buttons, dials, sliders, etc.) for selecting the various modes of the ice maker 126.

In one embodiment, the user interface 168 can include at least two actuators, each associated with a dedicated one of the 'normal ice' and 'clear ice' modes. In another embodiment, the user interface 168 can include a single actuator that is associated with both the 'normal ice' and 'clear ice' modes (i.e., toggles between these two modes). For example, the 'normal ice' mode may be activated by interacting with the actuator for a first, short time period (e.g., pressing the actuator for three seconds), and the 'clear ice' mode may be activated by interacting with the actuator for a second, longer time period (e.g., pressing the actuator for six seconds). In yet another embodiment, the 'normal ice' and/or 'clear ice' modes may be activated based on the user interacting with a combination of actuators (e.g., the 'clear ice' mode is activated by pressing two separate actuators simultaneously).

With reference to FIG. 8 a temperature-time graph of successive ice making cycles 300 is depicted (having temperature in Centigrade on the Y-axis and time in hours on the X-axis). As shown, a first ice harvesting phase A1 is followed by a subsequent, second ice harvesting phase A2. The time between the first and second ice harvesting phases A1, A2 is commensurate with a first ice making cycle B1 (e.g., ice making cycle 300, depicted in FIG. 7). The second ice harvesting phase A2 is followed by a subsequent, third ice harvesting phase A3. The time between the second and third ice harvesting phases A2, A3 is commensurate with a separate, second ice making cycle B2.

With respect to the second ice making cycle B2, the temperature-time curve is divided into three discrete sections. The change in temperature during each discrete section will now be discussed with the understanding that the below disclosure applies generally to each ice making cycle (e.g., the first ice making cycle B1, and any proceeding or subsequent ice making cycles).

In a first section C1 (occurring immediately after the second ice harvesting phase A2 from the proceeding, first ice making cycle B1), the temperature rapidly increases and then subsequently falls, generating a temperature spike 'D.' Notably, the rapid increase in the temperature is caused by filling water within the ice tray 144 (i.e., the filling phase 302, shown in FIG. 7) and the decrease in temperature is a result of said water being initially cooled. Accordingly, the temperature spike 'D' is indicative of a greatest (i.e., warmest) temperature of the ice tray 144 (and therefore of the water within the ice tray 144) throughout the duration of the filling phase 302, and even throughout the entire ice making cycle 300. The temperature spike 'D' can be determined by monitoring a temperature of the ice tray 144 during the filling phase 302 (e.g., by the temperature sensor 164 on the ice tray 144) and comparing successive temperature readings to determine when a slope of a temperature-time curve (generated by said successive temperature readings) changes from a positive integer to a negative integer, or from a negative integer to a positive integer. It is to be understood that the temperature spike 'D' may be determined in other ways or different steps, generally known and understood by those skilled in the art.

Next, in a second section C2, the temperature continues to decrease and then once more increases. This sudden increase in temperature (during the second section C2) is generally a result of partially frozen portions of water moving around within the ice tray 144. More specifically, said partially frozen portions of water within the ice tray 144 are displaced by unfrozen portions of water within the ice tray 144, thus requiring additional cooling to begin freezing said unfrozen portions of water, resulting in a sudden increase in temperature. Notably, an initial phase change status 'E' of the water can be detected during the second section C2 (e.g., via monitoring a sensed temperature of the ice tray 144 via the temperature sensor 164). That is, the initial phase change 'E' is indicative of a point in time where the liquid water begins to transition to a solid. More specifically, the initial phase change 'E' of the water can be determined by comparing a sensed temperature (of the ice tray 144 via the temperature sensor 164) to a stored predetermined temperature (e.g., stored in memory of the controller 162), or even by comparing a generated temperature-time curve (i.e., generated by taking successive temperature readings during a given time period) to a predetermined temperature-time curve and analyzing (via the controller 162) said curves for similar slopes, extreme data points, etc., indicative of an initial phase change of water. Further still, the initial phase change 'E' of the water can be determined by monitoring a rate of change of the temperature of the ice tray 144 (via the temperature sensor 164). For example, the controller 162 can be programmed to determine that the initial phase change 'E' has occurred when the rate of change of the temperature of the ice tray 144 reaches or approaches zero. It is to be understood that the initial phase change 'E' may be determined in other ways or different steps, generally known and understood by those skilled in the art. Monitoring the phase change status of the water (via successive temperature readings sensed by the temperature sensor 164) provides an assurance that the resultant frozen ice is fully frozen so that no hollow ice cubes are harvested.

Finally, in a third section C3, the temperature continuously decreases to ensure the above-noted criteria are met for harvesting (i.e., the sensed temperature being below the maximum harvest temperature). Of note, the temperature decrease between the temperature spike 'D' (occurring in the first section C1) and the initial phase change status 'E' (occurring in the second section C2) and the temperature decrease of the third section C3 are greater than the temperature decrease beginning in the second section C2. In other words, the sensed temperature between the spike 'D' and the initial phase change status 'E' as well as the temperature decrease in the third section C3 both decrease more rapidly than the temperature decrease following the initial phase change status 'E' in the second section C2.

When the ice maker 126 is operated in the 'normal ice' mode, the ice maker fan 146 is operational for an entirety of each separate ice making cycle (i.e., the first and second ice making cycles B1, B2). That is, the ice maker fan 146 is controlled (via the controller 162) to forcefully direct chilled air (cooled within the housing 148 of the air handler 140 via the ice maker evaporator 212) into the ice maker 126 (e.g., around the ice tray 144) during the filling phase 302, the freezing phase 304, and the harvesting phase 306 for each of the first and second ice making cycles B1, B2. Notably, in the 'normal ice' mode, the ice maker fan 146 is controlled (via the controller 162) to operate at a constant operational speed (i.e., in rotations per minute). That is, the speed at which the ice maker fan 146 operates does not vary during the 'normal ice' mode. In general, the ice maker fan 146 may be operational at its highest speed setting during the 'normal ice' mode.

As noted above, when the 'normal ice' mode is selected, the ice maker 126 produces a maximum amount of ice pieces in an efficient manner. This is due, in large part, to the continuous operation of the ice maker fan 146 at a constant operational setting (e.g., the highest speed setting) during the entirety of each ice making cycle B1, B2. In particular, the ice maker fan 146 continuously directs cool air into the ice maker 126 (i.e., around the ice tray 144) to promote the phase change of the water within the ice tray 144 as rapidly as possible. Due to insufficient time caused by this rapid cooling of the water, air bubbles are not able to escape from the water prior to the phase change, thereby resulting in the air bubbles being trapped within the produced ice pieces, and thus causing the produced ice pieces to be cloudy or opaque.

In comparison with the 'normal ice' mode where an operational state (i.e., running time and speed setting) of the ice maker fan 146 remains constant during an entirety of each ice making cycle B1, B2, the operational state of the ice maker fan 146 is adjustable when the 'clear ice' mode is selected. In particular, the controller 162 may control the ice maker fan 146 such that its speed setting is adjusted during any particular ice making cycle. For example, the operational state of the ice maker fan 146 is adjusted between a first speed and a second, lower speed.

In one example embodiment, when the 'clear ice' mode is selected, the first speed of the ice maker fan 146 can be its highest speed setting, and the second speed can be any non-zero speed setting, that is less than the first speed. In other words, the ice maker fan 146 can be a variable speed fan (e.g., pulse width modulation fan) that can operate within a range of speeds, for example between 0 rpm-4,000 rpm. For example, in this embodiment, the first speed can be 4,000 rpm (i.e., the highest possible speed setting) and the second speed can be 2,000 rpm.

During operation, the speed of the ice maker fan 146 during the freezing phase 304 is adjusted in order to slow down the cooling process of the water stored within the ice tray 144 to provide ample time for air bubbles to be released from the water in order to yield clear ice. Notably, the moment at which the operational speed of the ice maker fan 146 is adjusted can be purely time dependent. That is, the ice maker fan 146 can be operated at the first speed (e.g., 4,000 rpm) for an initial predetermined time interval, and then thereafter can be adjusted to the second speed (e.g., 2,000 rpm) for a subsequent predetermined time interval. The operational speed of the ice maker fan 146 can continue to be adjusted (i.e., between the first and second speeds) for further subsequent predetermined time intervals in order to slow down the cooling process of the water stored within the ice tray 144. In other words, an operational state of the ice maker fan 146 is cycled (during the freezing phase 304) between first and second speeds during predetermined time intervals.

Alternatively, the moment at which the operational speed of the ice maker fan 146 is adjusted can be both temperature and time dependent. For example, the controller 162 can be configured to monitor a rate of change of the temperature of the ice tray 144 (via the temperature sensor 164). At the beginning of the freezing phase 304, the ice maker fan 146 can be operated at the first speed (e.g., its highest speed setting—4,000 rpm). When the rate of change of the temperature of the ice tray 144 falls below a first predetermined value, then the controller 162 adjusts the ice maker fan 146 to operate at the second speed (e.g., 2,000 rpm). If the rate of change of the temperature of the ice tray 144 subsequently rises back above the first predetermined value, then the controller 162 again adjusts the ice maker fan 146 to operate at the first speed (e.g., 4,000 rpm). Alternatively, if the rate of change of the temperature of the ice tray 144 falls below a second predetermined value (i.e., a value smaller than the first predetermined value), then the controller 162 adjusts the ice maker fan 146 to operate at a third speed being lower than the second speed (e.g., 1,000 rpm).

It is to be understood that the operating values of the speed settings described above (e.g., 4,000 rpm, 2,000 rpm, and 1,000 rpm for the first, second, and third speeds, respectively) are merely examples, and may be any other operational values. Moreover, it is to be understood that the total number of speed settings of the ice maker fan 146 is not limited to the above-described three speed settings. For example, the ice maker fan 146 can have fewer or greater than three total speed settings. Further still, it is to be understood that the total number of predetermined values associated with the rate of change of the temperature of the ice tray 144 (monitored by the controller 162) is not limited to the above-described two predetermined values. For example, the controller 162 may monitor the rate of change of the temperature of the ice tray 144 with respect to any number of predetermined values, wherein when the rate of change of the temperature of the ice tray 144 falls below any given predetermined value, the ice maker fan 146 is operated at a different (lower) speed setting.

In addition to the ice maker fan 146 having varying speeds of operation, it is contemplated that the ice maker fan 146 need not be operational during an entirety of the freezing phase 304 of any given ice making cycle. That is, in one example, the ice maker fan 146 (being a variable speed fan) is operable in at least first, second, and third speed settings, wherein the first speed setting is the highest possible speed setting (e.g., 4,000 rpm), wherein the second speed setting is any non-zero speed setting, that is less than the first speed (e.g., 2,000 rpm), and wherein the third speed setting is a zero value (e.g., 0 rpm). Accordingly, in this example, when the ice maker fan 146 is set to the third speed setting (e.g., via the controller 162) the ice maker fan 146 is not operational.

In yet another embodiment, the ice maker fan 146 need not be a variable speed fan. For example, the ice maker fan 146 can be configured to simply cycle between a first speed setting (e.g., a highest possible speed setting—4,000 rpm), wherein the ice maker fan 146 is operational, and a second speed setting (e.g., 0 rpm), wherein the ice maker fan 146 is not operational. In other words, the ice maker fan 146 is cycled on (i.e., set to a first speed setting of, for example, 4,000 rpm) and off (i.e., set to a second speed setting of 0 rpm). Specifically, with reference to FIG. 9, a temperature-time graph of a single ice making cycle 300 is shown (having temperature in Centigrade on the Y-axis and time in hours on the X-axis). Notably, this graph depicts a temperature-time curve associated with the 'clear ice' mode of the ice maker 126 during the freezing phase 304 of the ice making cycle 300. When the 'clear ice' mode of the ice maker 126 is selected, the ice maker fan 146 is cycled on and off during the freezing phase 304 in order to slowly cool the water stored within the ice tray 144 over time to hinder or prevent air bubbles from being trapped within the produced ice pieces. Of note, during an ice making cycle 300 of the 'clear ice' mode, the ice maker fan 146 can be cycled on and off during only the freezing phase 304, or alternatively also during at least one other phase of the ice making cycle 300 (e.g., the filling phase 302 and/or the harvesting phase 306). As a result, instead of the produced ice pieces being cloudy or opaque, the produced ice pieces are relatively clear, providing enhanced aesthetics for the end user.

As depicted in the graph, when the ice maker fan 146 is not operational (schematically depicted as section(s) 'F,' in FIG. 9) the sensed temperature increases due to a lack of cool air flow being introduced into the ice maker 126 (i.e., a lack of cool air flowing around the ice tray 144). In contrast, when the ice maker fan 146 is operational (schematically depicted as section(s) 'G,' in FIG. 9) the sensed temperature decreases due to the forced cool air being introduced into the ice maker 126. The cycling of the ice maker fan 146 on (i.e., operational) and off (i.e., not operational) can occur during an entirety of the freezing phase 304 of the ice making cycle 300. Alternatively, the cycling of the ice maker fan 146 can occur during only a portion of the freezing phase 304.

Of note, the cycling of the ice maker fan 146 can be purely time based. Specifically, in one embodiment, timed cycles (i.e., predetermined time intervals) are preset to a desired time range (e.g., 20 seconds) and the ice maker fan 146 is set to be operational for a percentage of said desired time range. For example, the ice maker fan 146 can be operational for 20%-40% of each timed cycle. Thus, if each timed cycle has a time range of 20 seconds, and the ice maker fan 146 is set to be operational for 20% of each timed cycle, then the ice maker fan 146 will be operational for 4 seconds of each 20 second cycle and will not be operational for the remaining 16 seconds of each 20 second cycle. In other words, in the above-described embodiment, cycling of the ice maker fan is performed independent of any sensed temperature, and solely depends on programmed cycle times. That is, the amount of time the ice maker fan 146 is operational during each timed cycle remains constant, regardless of the temperature of the ice maker 126 (e.g., a sensed temperature of the ice tray 144).

In further embodiments, the cycling of the ice maker fan 146 can be both temperature and time dependent. For example, in one embodiment, the cycling of the ice maker fan 146 will only begin after the initial phase change status 'E' (as shown in FIG. 8) of the water has been detected. More specifically, after the initial phase change status 'E' of the water has been detected, the ice maker fan 146 can be operational for 12.5% and not operational for 87.5% of each timed cycle (e.g., 20 seconds). In yet another embodiment, the cycling of the ice maker fan 146 will begin after a predetermined temperature change has occurred following a detection of the spike 'D' (as shown in FIG. 8). For example, the cycling of the ice maker fan 146 will begin after the sensed temperate has decreased 1° C. from the detected temperature associated with the temperature spike 'D.'

In yet another embodiment, the percentage of time the fan is operational during each timed cycle can be dependent on temperature. For example, temperature recordings can be stored in memory over timed intervals (e.g., 5 minute intervals). Thereafter, an average temperature can be determined for each timed interval of two or more timed intervals. The largest average temperature (of the two or more timed intervals) can be set (i.e., assigned) as a maximum average temperature and the smallest average temperature (of the two or more timed intervals) can be set (i.e., assigned) as a minimum average temperature. If a temperature difference between the maximum and minimum assigned average temperatures is between a first predetermined temperature range (e.g., between 0.5° F. and 1° F.), then the ice maker fan 146 can be operational for a first percentage of each timed cycle (e.g., the ice maker fan 146 can be operational for 5% of a 20 second time range). Alternatively, if the temperature difference between the maximum and minimum assigned average temperatures is between a different, second predetermined temperature range (e.g., between 0° F. and 0.5° F.), then the ice maker fan 146 can be operational for a different, second percentage of each timed cycle (e.g., the ice maker fan 146 can be operational for 12.5% of a 20 second time range). It is to be understood that the above-noted ice maker fan 146 operational percentages and the predetermined temperature ranges are only examples of one embodiment, and that other operational percentages and/or predetermined temperature ranges are contemplated.

The above-describe ice maker 126 is operable in either a 'normal ice' mode or a 'clear ice' mode, dependent on the user's desired goal. If the user desires ice pieces to be rapidly produced, then the 'normal ice' mode can be selected, which operates the ice maker 126 such that the ice maker fan 146 is operational during an entirety of each ice making cycle 300 to continuously force cool air into the ice maker 126 (i.e., around the ice tray 144). Alternatively, if the user desires ice pieces to be relatively clear (i.e., transparent), then the 'clear ice' mode can be selected, which operates the ice maker 126 such that the ice maker fan 146 is cycled during the freezing phase 304 of a specified ice making cycle 300 to provide ample time for air bubbles to be released from the water stored within the ice tray 144. Accordingly, the aforementioned ice maker 126 provides the end user with multiple options with respect to produced ice pieces, thereby enhancing the end user's overall experience with the ice maker 126.

The invention has been described with reference to the example embodiments described above. Modifications and alterations will occur to others upon a reading and understanding of this specification. Example embodiments incorporating one or more aspects of the invention are intended to include all such modifications and alterations insofar as they come within the scope of the appended claims.

What is claimed is:

1. An ice maker for a refrigeration appliance, the ice maker comprising:

an ice maker frame;

an ice tray housed within the ice maker frame and configured to form ice pieces therein;

an air handler disposed adjacent the ice maker frame;

an ice maker fan disposed within the air handler and configured to direct cooled airflow out of the air handler and into the ice maker frame;

a controller configured to operatively control the ice maker during an ice making cycle; a user interface, and a temperature sensor configured to sense a temperature of the ice tray, wherein the ice maker is operable in a first mode and a second mode, wherein when the ice maker is operated in the first mode, the ice maker fan remains operational during an entirety of the ice making cycle and wherein when the ice maker is operated in the second mode, the ice maker is configured to produce clear ice pieces by cycling the ice maker fan on and off during predetermined time intervals, wherein the ice-making cycle of the first mode is completed during a shorter time period than the ice-making cycle of the second mode, wherein the user interface enables selection between the first mode and the second mode, wherein the cycling of the ice maker fan on and off during the predetermined time intervals of the second mode is dependent on a rate of change of the sensed temperature of the ice tray, and wherein the time the ice maker fan is cycled on during the predetermined time intervals of the second mode is reduced when a phase change is determined based on the sensed rate of change.

2. The ice maker according to claim 1, wherein the ice making cycle includes a filling phase, a freezing phase, and a harvesting phase, in that order, and wherein the ice maker fan is cycled on and off at predetermined time intervals of the second mode during the freezing phase of the ice making cycle.

3. The ice maker according to claim 1, wherein for each predetermined time interval of the predetermined time intervals of the second mode, the ice maker fan is operational within a range of 20%-40% of a total amount of time of each said predetermined time interval.

4. The ice maker according to claim 1, wherein if a temperature difference between average sensed temperatures of separate, preceding predetermined time intervals of the second mode is within a first predetermined temperature range, then the ice maker fan is operational for a first percentage of a total amount of time of a subsequent predetermined time interval of the second mode, and wherein if said temperature difference is within a second predetermined temperature range, then the ice maker fan is operational for a second percentage of the total amount of time of the subsequent predetermined time interval of the second mode.

5. The ice maker according to claim 1, wherein an ice maker evaporator is disposed within the air handler and provides the cooled airflow, wherein the ice making cycle includes a filling phase, a freezing phase, and a harvesting phase, in that order, wherein when the ice maker is operated in the first mode, the ice maker fan remains operational during an entirety of the ice making cycle, wherein when the ice maker is operated in the second mode, the ice maker fan is cycled on and off during said predetermined time intervals of the second mode, during the freezing phase, and wherein for each predetermined time interval of said predetermined time intervals of the second mode, the ice maker fan is operational within a range of 20%-40% of a total amount of time of each said predetermined time interval of the second mode.

6. A method of controlling an ice maker to produce clear ice pieces, the ice maker including an ice tray, an ice maker fan configured to direct cooled airflow about the ice tray, and a controller configured to operatively control the ice maker in a first mode or a second mode during an ice making cycle whereby ice is manufactured in each of the first and second modes, wherein the ice making cycle of the first mode is completed during a shorter time period than the ice making cycle of the second mode, wherein the ice making cycle includes a filling phase, a freezing phase, and a harvesting phase, the method comprising the steps of:

selecting, via a user interface, one of the first mode or the second mode;

initiating the filling phase such that water enters the ice tray;

thereafter initiating the freezing phase such that the water in the ice tray undergoes a phase change and transitions into frozen ice pieces;

sensing a temperature of the ice tray;

when the first mode is selected, operating the ice maker fan at a constant operational speed during an entirety of the ice making cycle;

when the second mode is selected, cycling the ice maker fan between a first speed and a second speed during predetermined time intervals, during the freezing phase, wherein the second speed is less than the first speed, wherein the cycling of the ice maker fan between the first speed and the second speed in the second mode is dependent on a rate of change of the sensed temperature of the ice tray;

wherein the time the ice maker fan is operated at the first speed during the predetermined time intervals of the second mode is reduced when a phase change is determined based on the sensed rate of change; and thereafter initiating the harvesting phase such that said frozen ice pieces are disengaged from the ice tray.

7. The method of claim 6, wherein the second speed of the ice maker fan is a zero value such that the ice maker fan is not operational.

8. The method of claim 7, wherein for each predetermined time interval of said predetermined time intervals, the ice maker fan is operational within a range of 20%-40% of a total amount of time of each said predetermined time interval.

9. The method of claim 6, further comprising the step of monitoring a temperature of the ice tray to determine an initial phase change of the water within the ice tray.

10. The method of claim 9, wherein the monitoring of the temperature of the ice tray occurs during the freezing phase of the ice making cycle.

11. The method of claim 9, wherein the cycling of the ice maker fan only occurs after the initial phase change of the water has been determined.

12. The method of claim 6, further comprising the step of monitoring a temperature of the ice tray during the filling phase to determine a temperature spike of the water within the ice tray.

13. The method of claim 12, wherein the cycling of the ice maker fan only occurs after the temperature spike of the water has been determined.

* * * * *